United States Patent [19]

Hill, Jr.

[11] Patent Number: 4,588,224

[45] Date of Patent: May 13, 1986

[54] BELT-ATTACHED SEAT

[76] Inventor: George W. Hill, Jr., 316 Morris St., Ogdensburg, N.Y. 13669

[21] Appl. No.: 609,811

[22] Filed: May 14, 1984

[51] Int. Cl.[4] ..... A47C 1/00

[52] U.S. Cl. ..... 297/4; 297/DIG. 6

[58] Field of Search ..... 297/4, DIG. 6, 219, 297/223, 283

[56] References Cited

U.S. PATENT DOCUMENTS

| | | | |
|---|---|---|---|
| 1,626,166 | 4/1927 | Stair | 297/4 X |
| 1,723,831 | 8/1929 | Weymouth | 297/4 |
| 2,736,030 | 2/1956 | Moody | 297/4 X |
| 3,062,580 | 11/1962 | Januin | 297/4 |
| 3,185,197 | 5/1965 | Spiro et al. | 297/DIG. 6 |
| 3,220,767 | 11/1965 | Hendrickson | 297/DIG. 6 |
| 3,313,511 | 4/1967 | Koerner et al. | 297/DIG. 6 |

*Primary Examiner*—Francis K. Zugel

*Attorney, Agent, or Firm*—Charles S. McGuire

[57] ABSTRACT

An insulated and waterproof seating pad for suspension from the rear part of a belt worn by the user. The pad comprises a single layer of foam material stitched along the center between the side edges to provide a fold line, covered by top and bottom layers of waterproof fabric stitched around the edges only. A first pair of flexible strips are attached to the top edge and a second pair to the bottom edge of the pad. The first pair of strips may be looped back upon themselves and the end portions secured to medial portions, preferably by making a portion of the strips from Velcro hook and another portion of Velcro pile material, providing closed loops to pass around the user's belt from which the seating pad is thus suspended. The second pair of strips are releasably attachable to portions of the first pair, also preferably by being of Velcro material, for moving the pad between folded (walking) and unfolded (seated) positions. The pad may be folded in either direction, with the second strips attachable to either side of the first, without being removed from the belt so that either of the two layers of fabric (preferably of different colors and/or patterns) are visible when the pad is in the folded position.

10 Claims, 4 Drawing Figures

BELT-ATTACHED SEAT

BACKGROUND OF THE INVENTION

The present invention relates to seating pads and, more particularly, to a foldable seating pad for suspension from the belt or other means on the rear of the outer garment worn by the user of the pad.

In a number of instances, principally connected with outdoor activities such as hunting, fishing, hiking, boating, sporting events, etc. it is desirable to have a padded cushion, or the like, for temporary seating. It is also often desirable under such circumstances that the seating pad provide some insulating and waterproofing qualities. However, it is sometimes impractical or inconvenient to carry such seating means and/or to retrieve it from a pack, bag, or the like.

It is a principal object of the present invention to provide a comfortable and convenient seating pad which may be transported by attachment to a portion of the user's wearing apparel.

Another object is to provide a novel and improved seating pad which is transported by the user in a position ready for immediate use, and which may be quickly and easily moved between positions of transport and use.

A further object is to provide a seating pad, intended primarily for outdoor use, which is conveniently transportable, and which provides insulation against loss of body heat and waterproofing.

Still another object is to provide a portable seating pad, carried exteriorly in a position easily adjustable as desired by the user.

A still further object is to provide a seating pad which may be used for other functions such as temporary storage and protection of other items, and a visual safety means for hunters.

Other objects will in part be obvious and will in part appear hereinafter.

SUMMARY OF THE INVENTION

In accordance with the foregoing objects, the invention contemplates a seating pad including an inner layer of resilient foam material enclosed by a layer of waterproof material such as a suitably treated cloth fabric, vinyl, or the like. The foam is stitched across the center to provide a fold line, the covering material being stitched around the edges and smoothly covering the fold line in the foam. On one of the edges parallel to the fold line, a pair of elongated strips are attached. These strips may be passed around the back of the user's belt, folded back upon themselves and releasably attached to form closed loops, thereby suspending the seating pad in a position ready for use.

A pair of shorter strips are attached to the edge of the pad opposite that to which the first pair are attached. The second pair of strips are releasably attachable to portions of the first adjacent the attachment thereof to the pad on either surface of both pairs of strips. The releasable attachment means is provided by hook and pile surfaces on the strips, the first strips being of one type for a first portion of their length on one surface and the other type on the same surface over a second portion ending at the free ends. Both outer surfaces of the second pair of strips also are of the type opposite that of the first portions of the first strips, thus being releasably attachable thereto. Thus, the size of the loops formed by the first strips, and therefore the distance below the user's belt at which the pad is positioned, is easily adjustable, and the seating pad may be quickly and easily moved between a folded position for walking, when the second strips are adhered to the first, and an unfolded position for sitting. Movement of the pad between the two positions is conveniently effected without removing the seating pad from the user's belt. The covering material is preferably of different colors and/or patterns on opposite sides to permit selection of which side is exposed when in the folded position depending upon the direction in which the pad is folded.

DETAILED DISCLOSURE

Figure 1:
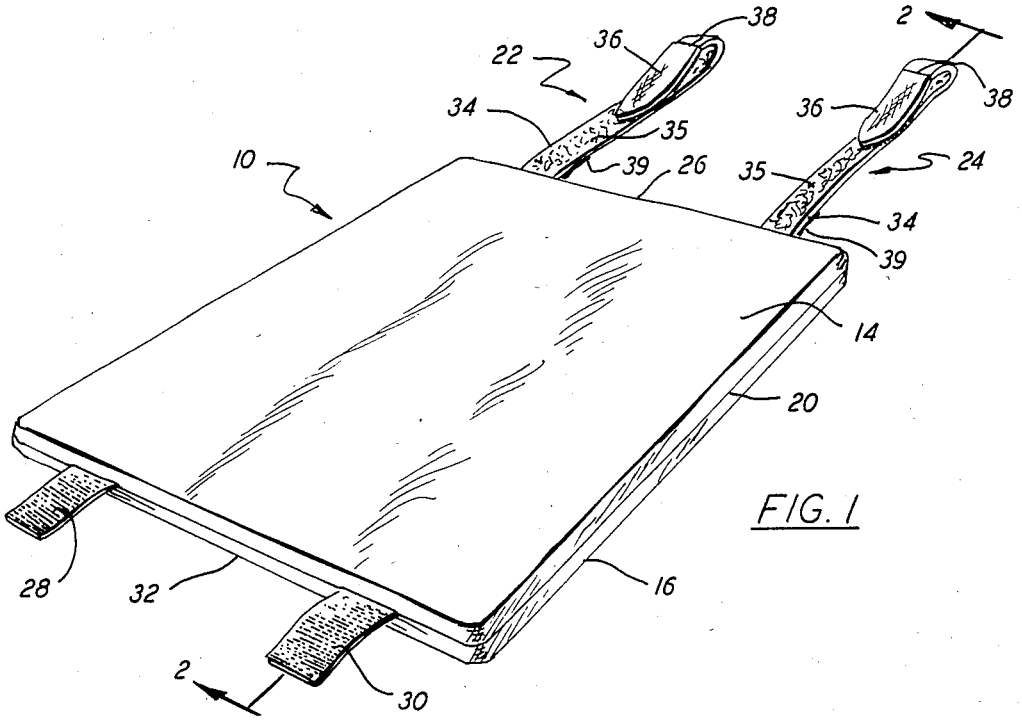
FIG. 1 is a perspective view of the preferred embodiment of the seating pad of the invention.

Referring now to the drawing, the seating pad of the invention is denoted generally by reference numeral 10 and comprises an inner layer of foam material 12 enclosed by layers of material 14 and 16. In the preferred construction, foam material 12 is a PVC closed cell foam pad, or equivalent, about ½ inch in thickness, whereby the pad will float if inadvertently dropped into the water. Layers of material 14 and 16 are a cloth material such as nylon, cotton or a cotton-polyester blend, with a conventional coating rendering the material essentially water-proof, or, alternatively, vinyl or other such flexible, waterproof material.

Figure 2:
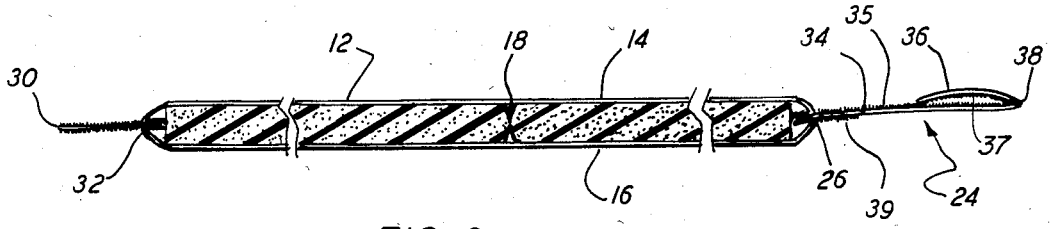
FIG. 2 is an elevational view in section on the line 2—2 of FIG. 1.

Foam material 12 is stitched across the center between the two side edges to provide seam 18 (FIG. 2) along which the material is then freely foldable in either direction. Material 12 is stitched prior to being covered on both sides by material layers 14 and 16, which are then stitched together around a continuous border seam 20, but not across the center. As the border seam is formed, a first pair of elongated strips 22 and 24 of flexible material are affixed to pad 10 along one edge 26, parallel to seam 18, and a second pair of strips 28 and 30 are similarly affixed along the opposite edge 32.

Strips 22 and 24 are each formed in two portions 34 and 36 attached along seams 38, portions 34 extending from attachment to edge 26 and seam 38 and portions 36 extending to the free ends of the strips. Strips 22, 24, 28 and 30 include surfaces of the familiar hook and pile material known as Velcro. Surfaces 35 of portions 34 are continuously of one type of Velcro, from edge 26 to seam 38, and surfaces 37 of portions 36 are of the opposite type, as are both surfaces of strips 28 and 30. In addition, surfaces 39 of portions 34 are of the first type in the area adjacent edge 26. Thus, strips 22 and 24 may be bent back upon themselves as illustrated to form closed loops and, with slight pressure, the facing surfaces 35 and 37 of portions 34 and 36, respectively, will adhere to one another, being likewise easily pulled apart when desired. In the same manner, the surfaces of strips 28 and 30 will releasably adhere to facing portions of surfaces 35 or 39 of portions 34 of strips 22 and 24 when pad 10 is folded upon itself along center seam 18.

Figure 3:
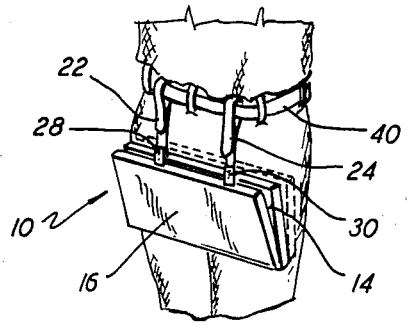
FIGS. 3 and 4 are perspective views of the seating pad shown attached to a belt worn by the user of the pad, shown in the two Figures in folded and unfolded positions, respectively.
Figure 4:
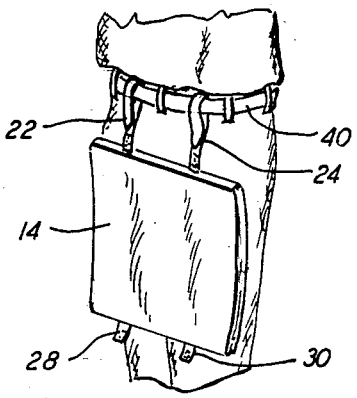

Pad 10 is shown in its intended manner of use in FIGS. 3 and 4. It is assumed that the user of the seating pad will be wearing a belt, such as indicated by reference numeral 40, or other means at the rear portion of the outer garments in the area of the waist to permit suspension of the seating pad in the manner illustrated. That is, strips 22 and 24 are passed around the belt and formed in loops by releasable attachment of the facing surfaces of portions 34 and 36. Seating pad 10 may then be folded upon itself and retained in the position shown in solid lines in FIG. 3 by releasably attaching strips 28 and 30 to the facing portions of surfaces 35 of strips 22 and 24, respectively. Alternatively, pad 10 may be folded in the opposite direction, to the dotted line position of FIG. 3 and releasably retained by attachment of the facing portions of strips 28 and 30 with surfaces 39 of strips 22 and 24. This is the position in which the seating pad will normally be carried when the user is walking or, in any case, not seated. When the user wishes to sit down upon any available surface, which in outdoor situations may be cold and/or wet, strips 28 and 30 are simply pulled away from strips 22 and 24 and the pad will fall open to the FIG. 4 position, being thus placed between the user and the seating surface without further positioning.

It will be noted that material layer 16 (or half of such layer) will be exposed when the pad is in the solid line folded position of FIG. 3, while the opposite layer 14 is exposed when the pad is in the dotted line folded position. It is preferred that material layers 14 and 16 be provided in two different colors or patterns. For example, when the pad is utilized by hunters, layer 16 may be of a highly visible color such as "safety orage" to promote ease of visibility of the user by other hunters, whereas layer 14 may be of a green and brown camouflage pattern, or other dark color, thus allowing the user to choose between high or low visibility surfaces.

From the foregoing, it may be seen that the invention provides a seating pad particularly advantageous in outdoor situations which is always available for use and transported while leaving the user's hands free. It is of extremely light weight, e.g., on the order of 6 ounces, and of low bulk while providing the desired insulating and waterproofing qualities. The loops by which it is suspended from the user's belt are adjustable in length to accommodate different sized users, and movement between folded and unfolded positions is easily accomplished without removing it from the user's belt, including movement between two alternative folded positions.

What is claimed is:

1. A transportable, foldable seating pad for suspension from a user's belt and reversible between either of two folded positions, said pad comprising:

(a) a layer of resilient foam material, foldable upon itself in either direction about a central fold line;

(b) a substantially waterproof material completely enclosing said resilient material, conforming in shape thereto and foldable therewith; said waterproof material comprising first and second layers respectively covering opposite sides of said resilient material;

(c) a first pair of flexible, elongated strips affixed at one end to said waterproof material at spaced points along a first edge, parallel to said fold line, and extending to free ends;

(d) means for releasably attaching each of said first strips to themselves to form closed loops adjacent said free ends;

(e) a second pair of flexible strips affixed to said waterproof material at points spaced equidistantly with said first pair of strips along a second edge, opposite said first edge, whereby said second pair of strips has surface portions superposed with opposing surface portions of said first pair of strips adjacent said first edge when said resilient material is folded upon itself in either direction along said fold line; and (f) means for releasably attaching said surface portions of said second strips to said superposed opposing surface portions of said first pair of strips, whereby said pad may be suspended from the rear of a user's outer garment which passes through the loops formed by said first pair of strips, and selectively moved between an unfolded and either of two folded positions wherein opposite ones of said first and second layers are outwardly exposed.

2. The invention according to claim 1 wherein said first pair of strips each comprise a first portion extending from said one end for part of the length of said strips and carrying first attachment means, and a second portion extending continuously with said first portion to said free ends of said strips and carrying second attachment means, cooperable with said first attachment means to releasably attach said first and second portions to form said closed loops.

3. The invention according to claim 2 wherein said first attachment means comprises one and said second attachment means the other of hook and pile fabric material.

4. The invention according to claim 3 wherein said second pair of strips comprise the other of said hook and pile fabric material.

5. The invention according to claim 4 wherein said first pair of strips includes said one fabric material on both surfaces thereof in the area adjacent said one ends, and said second strips include said other fabric material on both surfaces thereof, whereby said pad may be selectively folded upon itself in either direction along said fold line and releasably retained by attachment of said second strips to the facing surfaces of said first strips.

6. The invention according to claim 1 wherein said layer of resilient material is stitched from edge to edge to provide a central seam along which said resilient material is freely foldable.

7. The invention according to claim 6 wherein said first and second layers of waterproof material comprise different colored layers of a treated cloth fabric secured to one another about peripheral edges of each in covering relation to said layer of resilient material.

8. The invention according to claim 7 wherein said layers of cloth material are physically unattached to said layer of resilient material.

9. The invention according to claim 8 wherein said layer of resilient material comprises a foam material at least about ½ inch in thickness.

10. The invention according to claim 9 wherein said foam material is a PVC closed cell foam pad.

* * * * *